US007982187B2

(12) United States Patent
de Gorordo

(10) Patent No.: US 7,982,187 B2
(45) Date of Patent: Jul. 19, 2011

(54) METHOD AND APPARATUS FOR PHOTON-ASSISTED EVALUATION OF A PLASMA

(76) Inventor: Alvaro Garcia de Gorordo, Austin, TX (US)

( * ) Notice: Subject to any disclaimer, the term of this patent is extended or adjusted under 35 U.S.C. 154(b) by 218 days.

(21) Appl. No.: 12/251,045

(22) Filed: Oct. 14, 2008

(65) Prior Publication Data

US 2010/0090106 A1 Apr. 15, 2010

(51) Int. Cl.
*H01J 47/00* (2006.01)

(52) U.S. Cl. ..... 250/309; 250/251; 250/305

(58) Field of Classification Search ..... 250/251, 250/305, 309

See application file for complete search history.

(56) References Cited

U.S. PATENT DOCUMENTS

| | | | | | |
|---|---|---|---|---|---|
| 3,287,598 | A | | 11/1966 | Brooks | |
| 3,733,248 | A | * | 5/1973 | Chu et al. | 376/143 |
| 3,755,073 | A | * | 8/1973 | Haught et al. | 376/122 |
| 3,817,622 | A | | 6/1974 | Billman et al. | |
| 3,833,851 | A | | 9/1974 | Jobes, Jr. et al. | |
| 4,442,354 | A | * | 4/1984 | Hurst et al. | 250/281 |
| 4,714,834 | A | | 12/1987 | Shubaly | |
| 4,775,789 | A | * | 10/1988 | Albridge, Jr. et al. | 250/251 |
| 5,153,430 | A | * | 10/1992 | Gammel et al. | 250/251 |
| 5,270,222 | A | | 12/1993 | Moslehi | |
| 5,365,063 | A | * | 11/1994 | Kaesdorf et al. | 250/288 |
| 5,601,654 | A | | 2/1997 | Springer | |
| 5,637,188 | A | * | 6/1997 | Amme et al. | 438/708 |
| 6,068,783 | A | | 5/2000 | Szetsen | |
| 6,184,623 | B1 | | 2/2001 | Sugai et al. | |
| 6,326,794 | B1 | | 12/2001 | Lundquist et al. | |
| 6,744,211 | B2 | | 6/2004 | Sugai et al. | |
| 7,061,184 | B2 | | 6/2006 | Kim et al. | |
| 2009/0266984 | A1 | * | 10/2009 | Hirano | 250/288 |
| 2010/0090106 | A1 | * | 4/2010 | De Gorordo | 250/305 |

OTHER PUBLICATIONS

Garcia De Gorordo, A., et al., "Photon Assisted Beam Probes for Low Temperature Plasmas", (Abstract: WF1.00002), *Meeting of The American Physical Society, 61st Annual Gaseous Electronics Conference (GEC08), Bulletin of the American Physical Society*, 53(10),), (2008), 1 pg.

Bendali, N., et al., "$Na^+$—Na charge exchange processess studied by collinear laser spectroscopy", *J. Phys. B: At. Mol. Phy.*, 19, (1986), 233-238.

(Continued)

*Primary Examiner* — David A Vanore

(74) *Attorney, Agent, or Firm* — Schwegman, Lundberg & Woessner, P.A.

(57) ABSTRACT

Described are a method and apparatus for evaluating a least one characteristic of a plasma. The described method uses photons to raise the excitation state to or past the point of ionization of atoms which will traverse the plasma to be evaluated. The ionization of the atoms, followed by the measurement of the energy of any resulting secondary ions, facilitates the determining of one or more characteristics of the plasma. In one example, the photons are provided by a laser which directs a beam to intersect, and in some examples to be collinear with, a beam of atoms directed through the plasma.

14 Claims, 3 Drawing Sheets

OTHER PUBLICATIONS

Garcia De Gorordo, A., et al., "Heavy Atom Neutral Beam Probe", *American Physical Society, 49th Annual Meeting of the Division of Plasma Physics*, (Abstract #PP8.141), (Nov. 12-16, 2007), 1 pg.

Garcia De Gorordo, A., et al., "Photon Assisted Beam Probes for Low Temperature Plasmas", (Aug. 25, 2008), 1-9.

Melnikov, A. V., "Heavy Ion Beam Probe investigations of plasma potential in ECRH and NBI in the TJ-II stellarator", *33rd EPS Conference on Plasma Phys. Rome, ECA* vol. 301, O-3.017, (2006), 4 pgs.

Solensten, L., et al., "Heavy ion beam probe energy analyzer for measurements of plasma potential fluctuations", *Rev. Sci. Instrum.* 58(4), (1987), 516-519.

Goncalves, B M, et al., "Plasma potential profile determination by a new diagnostic based on neutral particle beam injection and laser induced fluorescence", Review of Scientific Instruments, 70(1), (Jan. 1999), 908-11.

* cited by examiner

METHOD AND APPARATUS FOR PHOTON-ASSISTED EVALUATION OF A PLASMA

BACKGROUND OF THE INVENTION

The present invention relates generally to methods and apparatus that may be used for evaluating a plasma, and more specifically relates to such methods and apparatus providing improved evaluating of plasmas, particularly those for which previous measurement techniques have offered less than optimal results.

A number of systems have been used or considered for evaluating of plasmas formed in chambers or similar devices. In many circumstances the systems have been configured to measure relatively high temperature and/or high density plasmas. For example, systems such as Heavy Ion Beam Probes have been used for such purposes. While different configurations of Heavy Ion Beam Probe systems are known for evaluating different types of plasma devices, in general, such systems operate by directing an ionized beam through the plasma, where the ions will become "heavy ions" through electron impact within the plasma, thereby becoming "doubly ionized". The doubly ionized particles will then be deflected by the magnetized plasma, and detected by an energy analyzer which can then discern the energy gained by the ions, and from that energy data identify the electric potential of the plasma at the point of ionization.

One limitation of such Heavy Ion Beam Probe systems is that the incident electron impact energy must be equal to or greater than the second stage ionization potential of the ions in the beam. Thus, a significant limitation on such Heavy Ion Beam Probe systems is that they are not suitable for use with relatively low temperature plasmas, for example, plasmas operating at approximately 1-2 eV. Such plasmas typically do not have enough sufficiently hot electrons to achieve significant second stage ionization in the ion beam, and thus signal levels are generally very low.

This limitation on such probe systems is significant particularly to industries such as the semiconductor manufacturing industry, which typically uses "cold plasmas," that is plasmas with electron temperatures of approximately 2 electron volts or less. However, measurement of plasma characteristics is very important in the semiconductor industry because the plasma may have a significant impact on the semiconductor manufacturing process. Because of this need to measure these cold plasmas, the most common techniques currently used to measure the plasma in semiconductor systems have used Langmuir probes inserted into the plasma. With such probes, however, the measurements are less than optimal because the mere presence of the Langmuir probe disrupts the plasma to at least some degree. Additionally, the measurement may only be made at a single point in the plasma, and is often believed to be inaccurate.

An additional concern arises in some applications, and is exemplified in the semiconductor manufacturing industry, where the real need is to evaluate the plasma potential (voltage) and density across a geometrical dimension. For example, in semiconductor manufacturing, the vast majority of such manufacturing is done by depositing or otherwise forming a succession of patterned layers on a circular substrate such as a thin silicon wafer. Many forms of deposition operations and patterning operations, such as etching, involve the use of plasma mechanisms. The current conventional technology forms such layers on a 300 mm diameter wafer, and a critical factor in such manufacturing is the consistency of deposition or etching operations across the entire dimension of that wafer. Additionally, a varying plasma gradient across the wafer may create localized plasma charging resulting in damage to the structures formed, such as the gate oxide layer. Accordingly, for that industry, the currently-available techniques do not provide either a system capable of measuring the relatively cold plasmas that are typically of interest, or a mechanism for identifying any irregularities or discontinuities in plasma characteristics across the wafer dimension. While similar needs are believed to be experienced in other industries, the semiconductor manufacturing industry provides an accessible and understandable example of where currently-known plasma measurement methods and systems fail to provide capabilities that would be beneficial to the industry.

Accordingly, the present invention provides new methods and apparatus for evaluating plasmas which is capable of evaluating relatively cold plasmas, as well as hotter plasmas; and which in some examples provide additional capabilities of profiling plasmas across the dimension of the plasma.

SUMMARY OF THE INVENTION

The present invention utilizes a photon source to assist ionization of atoms used for evaluating at least one characteristic of a plasma. In the described examples of the invention, a beam of neutral atoms ("neutrals") will be directed toward the plasma, and some portion of those neutrals will be excited, and in some preferred examples ionized, through interaction with photons from a photon source such as, in some examples, a laser. Through the combination of the photon interaction increasing the kinetic energy of the neutrals, and the interaction of the plasma on those neutrals or ions, the ions will experience a net energy increase. The subsequent measurement of these results of the energy of the ions allows evaluating one or more characteristics of the plasma. In some examples, the ionized beam neutrals will be evaluated by an energy analyzer, as described in more detail later herein.

DETAILED DESCRIPTION OF PREFERRED EMBODIMENTS

The following detailed description refers to the accompanying drawings that depict various details of embodiments selected to show, by example, how the present invention may be practiced. The discussion herein addresses various examples of the inventive subject matter at least partially in reference to these drawings and describes the depicted embodiments in sufficient detail to enable those skilled in the art to practice the invention. However, many other embodiments may be utilized for practicing the inventive subject matter, and many structural and operational changes in addition to those alternatives specifically discussed herein may be made without departing from the scope of the inventive subject matter.

In this description, references to "one embodiment" or "an embodiment," or to "one example" or "an example" mean that the feature being referred to is, or may be, included in at least one embodiment or example of the invention. Separate references to one or more examples or embodiments in this description are not intended to refer necessarily to the same embodiment; however, neither are such embodiments mutually exclusive, unless so stated or as will be readily apparent to those of ordinary skill in the art having the benefit of this disclosure. Thus, the present invention can include a variety of combinations and/or integrations of the embodiments described herein, as well as further embodiments as defined within the scope of all claims based on this disclosure, as well as all legal equivalents of such claims.

Figure 1:
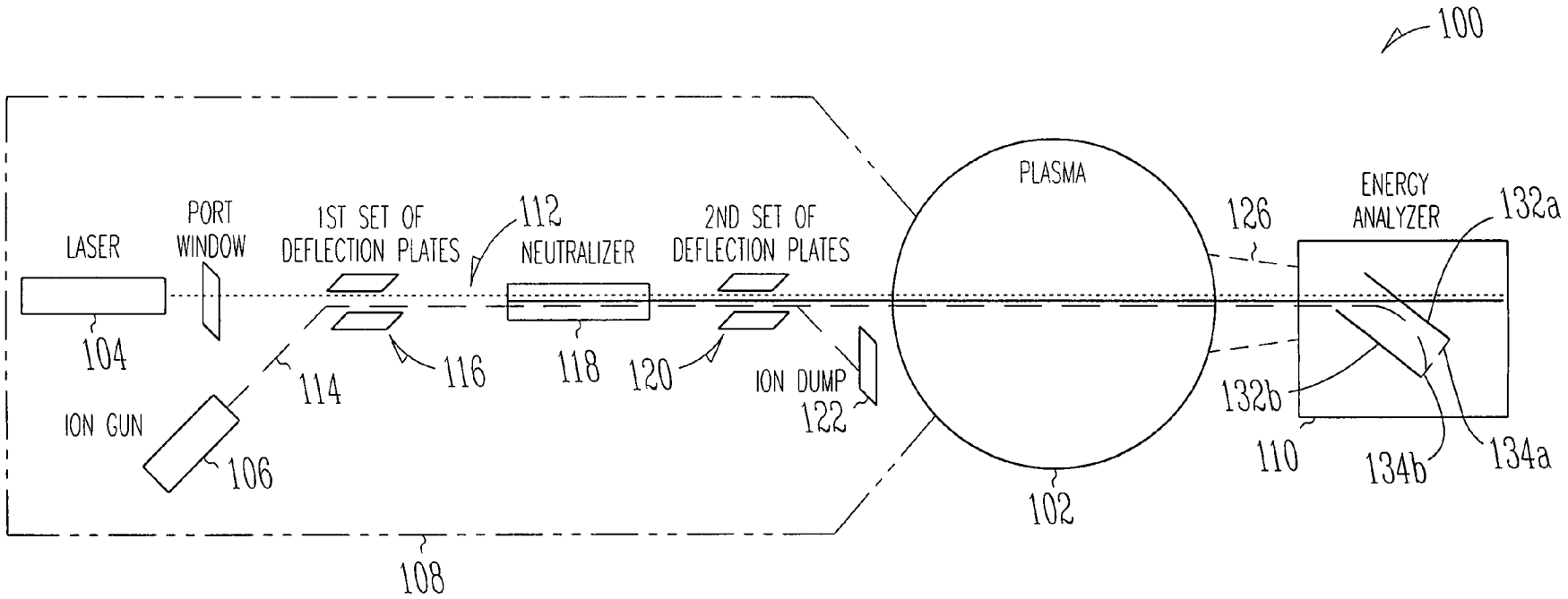
FIG. 1 schematically depicts an example of one system for monitoring plasmas in accordance with the present invention.

Referring now to the drawings in more detail, and particularly to FIG. 1, therein is depicted in block diagram form, one example embodiment of a system 100 for evaluating a plasma in accordance with the present invention. For purposes of the present description, the term "evaluating" is used in its broadest context, and encompasses any measuring, determining or estimating. Similarly, each of those terms are used in their broadest scope. For example, "measuring" a plasma includes making any type of comparative, qualitative or quantitative measure of any property or indicator of a plasma, whether such measure is a single measurement, or represents monitoring over some time interval, whether such monitoring is continuous, periodic or intermittent. For purposes of the present description, the example will be discussed in the context of evaluating a plasma within a chamber 102 generally of a type suitable for use in a semiconductor manufacturing operation, either for deposition or etching. Although such chambers for these different purposes will not necessarily be interchangeable, for purposes of illustrating an environment of present invention, they may be considered similarly. Accordingly, chamber 102 will be discussed for purposes of the present example, as a chamber meant to operate with a plasma having an electron temperature ($T_e$) of approximately 2 eV, and existing over a diameter of approximately 300 mm (the diameter of the majority of current semiconductor wafers). As will be apparent to those skilled in the art, a plasma of this dimension typically requires a chamber having an internal diameter of at least 14 to 18 inches, and even larger in many cases.

As depicted in FIG. 1, system 100 includes a laser 104 and an ion gun 106 that will each be at least partially housed within a pressure housing 108 in fluid communication with the interior of chamber 102, and therefore maintained at the same pressure as that within chamber 102. As will be apparent to those skilled in the art, it is not essential that laser 104 and ion gun 106 each be entirely retained within pressure housing 108. However, at least the output of each device will be within pressure housing 108. Pressure housing 108 may be of any appropriate form sufficient to house the identified components in an operative configuration, as described herein, and to support a vacuum as intended within chamber 102.

Several types of lasers may be suitable for use in various examples of systems constructed in accordance with the principles described herein, depending on the specific operating parameters for which those systems are intended. For the system intended for operation in the example environment identified for this example, and with the parameters identified above, laser 106 will preferably be a pulsed excimer laser operating at a wavelength ($\lambda$) of 193 nm, with an example pulse duration ($\Delta T_p$) of approximately 12 ns, and a pulse repetition rate $f_{rep}$ of approximately 1 kHz. In one presently-defined embodiment, the laser will have a pulse energy ($u_p$) of approximately 11 mJ, and a beam cross-sectional area of approximately 18 $mm^2$.

Ion gun 106 may again be of a number of different possible structures. In one currently-contemplated structure ion gun 106 will be a multi-stage Pierce-type extractor, having an Einzel lens. In one currently-identified structure, the ion gun will provide sodium (Na) ions with a beam energy ($E_b$) of approximately 10 keV, and a beam ion velocity (v) on the order of $2.9\times10^5$m/s. As will be described later herein, in some environments it may be desirable to use ions of a different element.

As can be seen in FIG. 1, laser 104 is placed and oriented to direct the beam along a path, indicated generally at 112, through additional equipment, as will be described below, through chamber 102, and toward energy analyzer 110. As shown in FIG. 1, in this example, embodiment laser path 112 extends across the diameter of chamber 102, and thus laser 104 and energy analyzer 110 are on essentially diametrically opposite sides of chamber 102. While the directing of this path will in some cases be a matter of design choice, a laser path extending across the approximate diameter of chamber 102 will be a preferred structure for many applications.

As can be seen in FIG. 1, in this example system the preferred configuration will also direct the ion beam from ion gun 106 generally along path 112. Thus, in this example configuration, the laser beam, when energized, is coincident with a portion of the ion beam along path 112. Although multiple configurations are possible to achieve this result, because it is relatively straightforward to steer the ion beam, system 100 includes ion gun 106 oriented at an angle relative to path 112 but directed toward the input side of a beam steering mechanism 116 configured to re-direct the ion beam through either magnetic or electrical interaction with the beam. As depicted in system 100, beam steering mechanism 116 includes a first pair of deflection plates that will re-orient the ion beam from its original trajectory indicated generally at 114, to along path 112. The deflection plates may be of any suitable configuration as may be determined by those skilled in the art, but for example may be approximately 3 inches square, and spaced approximately 3 inches from one another, each charged to a voltage of approximately 3 kV between them. As will be described later herein, other mechanisms may be used to establish a magnetic field to provide the needed steering of the ion beam.

System 100 also includes a charge exchange chamber, or neutralizer, 118 configured to neutralize the charges on the sodium ions in the beam from ion gun 106. A neutralizer 118 may be of any suitable configuration to facilitate charge exchange of the ions. In one example, a source of neutral sodium gas may be provided within the chamber, whereby the neutral sodium atoms will facilitate a charge transfer with a substantial portion of the sodium ions. Downstream of neutralizer 118, there will be another steering mechanism 120, again such as a set of charged deflection plates. The purpose of this second steering mechanism is to deflect any remaining ions from the beam toward an ion dump, thereby leaving neutrals in the beam that will pass into chamber 102, and thus through the plasma therein. Where deflection plates 120 are used, again each plate may be approximately 3 inches square, with positively and negatively-charged plates placed to steer remaining charged ions to ion dump 122. Ion dump 122 may be just a grounded plate placed to collect the deflected positively-charged ions. As a result, the beam of atoms entering chamber 102 is generally limited to neutrals, except to the extent that the neutrals are ionized by the photons from the pulsed laser. As will be described in more detail later herein, because such laser energy is known, the energy gained by the neutrals by intersecting the plasma within chamber 102 may also be determined.

Figure 4:
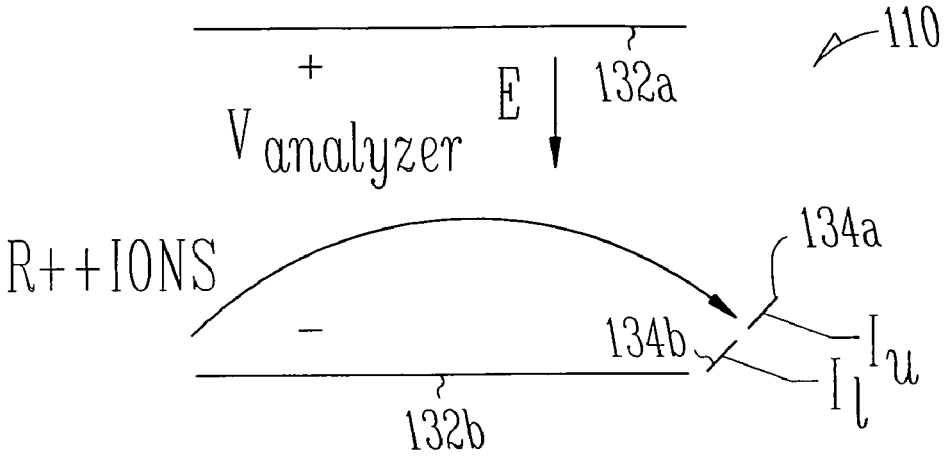
FIG. 4 schematically depicts the energy analyzer from the system of FIG. 1 in greater detail.

On the opposite side of chamber 102 is found energy analyzer 110, as discussed earlier herein. Again, a pressure housing 126 will couple energy analyzer 110 to chamber 102, such that energy analyzer 110 is also at a common pressure and in fluid communication with chamber 102. Energy analyzer 110 is preferably a Proca-Green-type analyzer, as is well-known in the art. Such analyzers use a pair of spaced, charged plates, indicated generally at 132*a-b*, to deflect ions in the beam in functional relation to the energy of those ions (also schematically depicted in FIG. 4, in greater detail). Energy analyzer 110 also includes a pair of charge collection, or detector, plates (134*a-b* in FIG. 4) which are coupled to appropriate circuitry (not depicted) configured to determine the relative current on each plate. The ratio of the currents will indicate the energy of the beam. The determination of the specific configuration and operating parameters of the energy analyzer will be highly dependent on the configuration of the entire system 100, as well as of the analyzer 110 itself. The identification of an appropriate configuration, and of appropriate operating voltages and other parameters, is considered to be within the level of one skilled in the art having the benefit of the present disclosure. As will be apparent to those skilled in the art, energy analyzer 110 may include, or may be coupled to, a suitable recording mechanism configured to capture the data from energy analyzer 110.

The described current ratio measurement at any selected time interval represents a measurement of the ion energy at that time interval, and is thus directly representative of the plasma energy at that time interval. The correlation of that time-based measurement to a distance measurement across the plasma may be accomplished as described below.

As is well known to those skilled in the art, energy analyzer 110 will require calibration. This is typically performed with the neutralizer turned off and with no plasma present. For the calibration and for the measurement itself, the currents detected on the two detector plates are monitored. As with an actual measurement as noted above, the incoming beam of ions will straddle the two plates, and the ratio of the currents will indicate the energy of the beam. For calibration, the gun voltage will be fixed, and the voltage of the analyzer will be varied. This will allow the determining in situ of two analyzer parameters known in the literature as "G" and "F," representative of the geometric characteristics of the analyzer, as are empirically determined relative to the specific analyzer configuration at issue. The determination of such parameters are well-known in the art, and as one example, may be determined in accordance with the teachings of L. Solensten and K. A. Connor, "Heavy Ion Beam Probe Energy Analyzer For Measurement of Plasma Potential Fluctuations," Rev. Sci. Instrum. Vol. 58, No. 4, 1987; which is hereby incorporated herein by reference to demonstrate the state of the prior art.

Once energy analyzer 110 is calibrated, the potential (V) at any point in time may then be determined by a relation such as the following:

$$V = V_A\left(\frac{(i_U - i_L)}{(i_U + i_L)}F + G\right) - V_G \qquad \text{eq. 1}$$

Where:

$i_U$ represents the current detected on the upper plate of the energy analyzer, $i_L$ represents the current detected on the lower plate of the energy analyzer, $V_A$ represents the variable voltage of one deflection plate of the energy analyzer, and $V_G$ represents voltage of the ion gun.

In performing a plasma measuring operation, ion gun 106 and laser 104 will be actuated as described above to direct a beam of, in this example, sodium atoms through a plasma within chamber 102, and the ions charged as a result of the laser and the plasma will be detected by energy analyzer 110. In the course of that operation, the sodium ions in the accelerated beam will be neutralized by neutralizer 118, and the remaining charged ions removed by the second steering mechanism, such as deflection plates 126, before the atoms enter chamber 102 and encounter the plasma therein. The described laser pulse from laser 104 can excite, and preferably ionize, the entire beam of atoms, including within chamber 102, and for all practical purposes, virtually instantaneously. As a result, after such excitation, and preferably ionization, the first detected ions will likely be ions outside of the plasma, having already have passed through the plasma before interacting with the laser beam photons (depending upon the configuration of the system surrounding chamber 102). Subsequently, a string of ions will be detected, coming from the plasma sheath proximate the output port of chamber 102; followed by ions across the dimension of the plasma; followed by ions from the sheath proximate the input port; and then potentially outside of chamber 102 on the input side. For example, a hypothetical detector signal may be expected to look something like the hypothetical curve 200 depicted in FIG. 2. By correlating the time scale of the x-axis of FIG. 2 with the velocity of the ion beam, the measured plasma energy reflected in curve 200 can be correlated with the diameter of the plasma to provide an energy profile of the plasma within chamber 102. Correlation of the time to the distance dimension of the measurement may be obtained by multiplying the time by the speed of the neutral beam. The speed of the neutrals is determined by the energy (E) and the mass (m) as in the following equation:

$$v = \sqrt{(2E/m)} \qquad \text{eq. 2}$$

The energy of the neutral beam is known from the energy imparted to the ions out of the ion gun, and the mass is known from the species of ions from the gun.

This type of profile can be very useful, for example, when designing a chamber, so as to identify irregularities or undesirable properties within the chamber, such as may be caused by various structures or configurations within the chamber. Additionally, it is contemplated that periodic measurements of the type described herein may be useful during the actual use of a chamber, such as in a semiconductor manufacturing process. As is well known to those skilled in the art, during such manufacturing operations a number of wafers will be processed, and the number of active and/or carrier gases may be introduced into a chamber, such as source gases for deposition processes and etching or otherwise reactive gases for etching or other removal processes. Typically, after multiple such cycles the chamber will experience build up of deposition products or byproducts on various surfaces, and over time this build-up can degrade performance of the chamber, in some cases by interfering with the generation or uniformity of the plasma that will be formed within the chamber. Accordingly, it is contemplated that at least for some types of chambers and/or operations, periodic measurements of the type described herein could identify when a chamber needs cleaning, repair or other remedial action.

Figure 2:
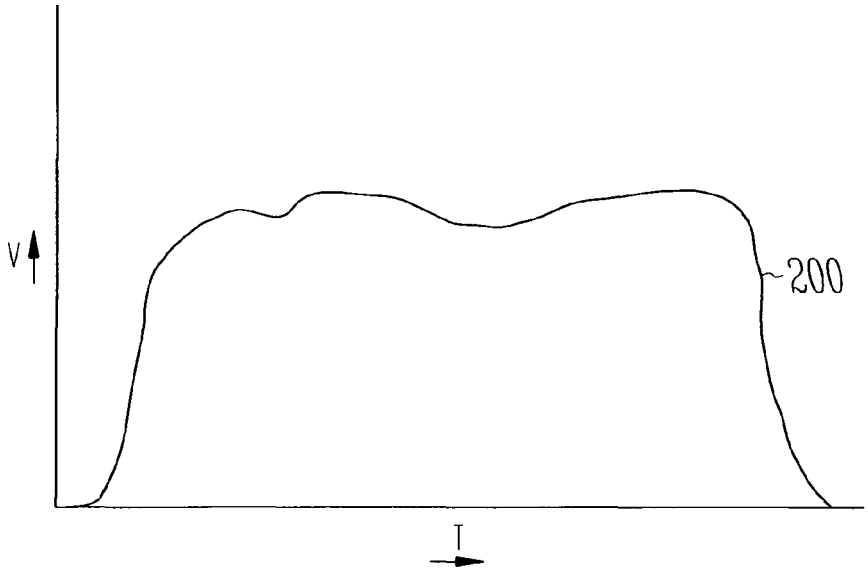
FIG. 2 depicts a hypothetical waveform of plasma energy as may be expected from the performing of the evaluating method as described herein.

Referring again to the curve of FIG. 2, the described current ratio, ion energy measurement is directly representative of the plasma potential, as the plasma potential is equal to the ion energy gained (that is the difference between the ion energy measurement and the initial ion energy) divided by a constant. The constant is known as the elementary charge, which is the same as that of an electron and has a value of approximately $1.6022\times10^{-19}$ coulombs. The curve from FIG. 2 will look exactly the same, but the vertical scale will change to the plasma potential (voltage) as mentioned. In some circumstances, it may be possible to evaluate, at least by estimating, the actual plasma density. For example, with certain parameters known or estimated, the plasma density can be inferred from Boltzmann's relation:

$$n_e=n_0e^{(V/T_e)} \quad \text{eq. 3}$$

Where:

V is the potential of the plasma in volts, $T_e$ is the electron temperature in electron volts, and n is the density (here, the electron density ($n_e$) is equal to a reference density ($n_o$) multiplied by the exponential). The reference density can be determined where the following parameters are known or estimated: the plasma potential, the electron temperature, and the density at any point in the plasma. Even in the absence of these three parameters, Boltzmann's relation together with the plasma potential profile and the electron temperature can generate a plasma density profile identifying the relative value of the plasma density across the dimension of the plasma, although not reflecting the absolute value of the density. Such a relative plasma density is still a measurement of significant importance when evaluating the uniformity of a plasma within a chamber, such as one used for semiconductor processing.

In applications in which it is desired to monitor a chamber actively used in semiconductor manufacturing, the use of sodium ions may be considered undesirable, as sodium, in many cases is considered a contaminant to the actual manufacturing operations. In such circumstances, therefore, it may often be preferable to use alternative ions, such as for example, calcium (Ca), germanium (Ge), magnesium (Mg) or aluminum (Al). When using these alternative ions, one point to be addressed will be the energy required to ionized the neutrals in the beam. In some cases, such as that of germanium, this may be possible with other commercially available lasers, such as, for example, a 157 nm laser. Other shorter-wavelength lasers would be suitable for use with these other ions. However, at the present time, those lasers are less cost-effective for general commercial practice of the described techniques.

Figure 3:
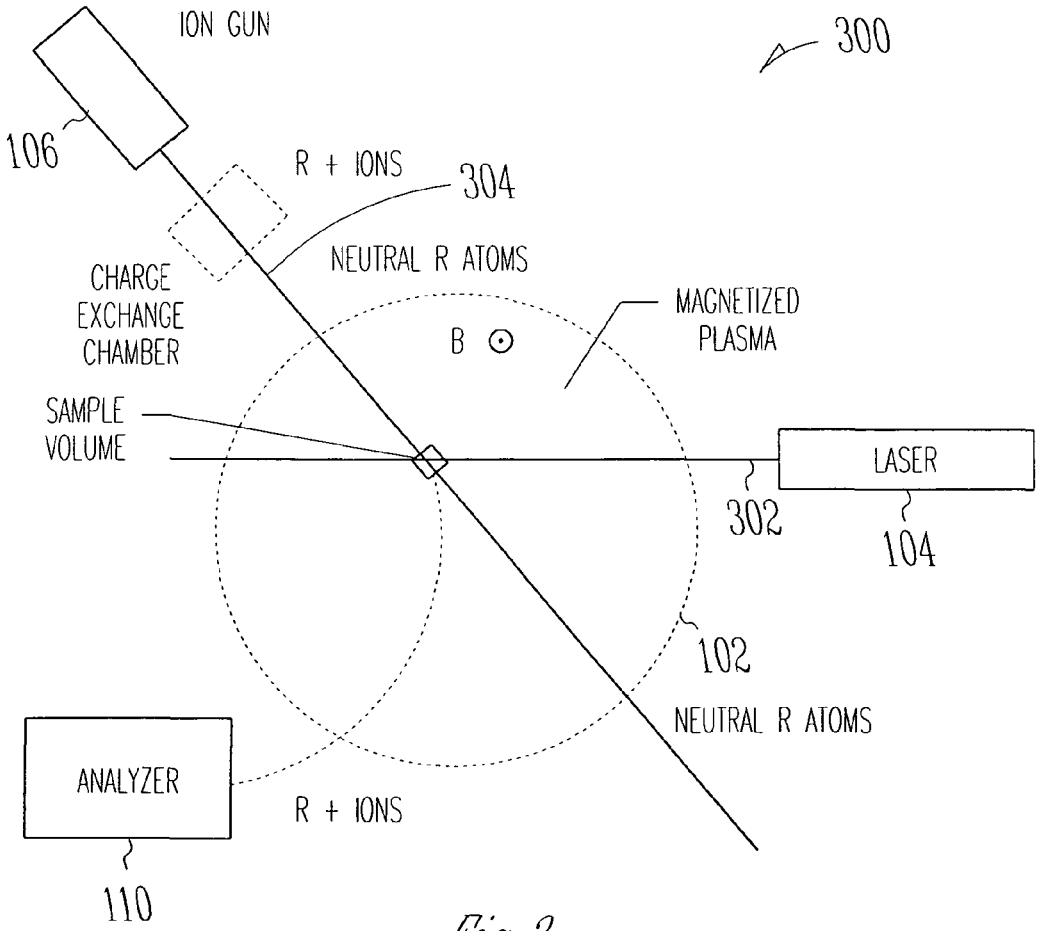
FIG. 3 depicts an example of an alternative system for monitoring plasmas in accordance with the present invention.

Referring now to FIG. 3, therein is depicted an alternative embodiment of a system 300 for evaluating a plasma. Components that are substantially similar to those described in reference to system 100 depicted in FIG. 1 are numbered similarly here. As the basic function of the described components is similar to that previously discussed, only the primary differences will be addressed here. As is apparent from FIG. 3, the laser 104 is no longer directing a beam 302 along a path that is coincident with the beam of ions 304 from ion gun 106. Accordingly, laser 104 is oriented to cause beam 302 to intersect beam 304 from ion gun 106. In system 300, the ions resulting from interaction with photons of a laser beam 302 are deflected by a magnetic field resulting from the plasma within chamber 102. In the absence of the plasma generating such a magnetic field, alternative structures would have to be supplied in order to provide the necessary deflection of the secondary ions. Although not depicted in FIG. 3, and similar to the system depicted in FIG. 1, ion gun 106, laser 104 and analyzer 110 are all within a pressure housing enabling fluid communication and a common pressure with chamber 102.

As will be appreciated from consideration of FIG. 3, the identified system only provides a measure at the point of ionization, the intersection of the photon beam with the neutral beam within the plasma. Because the measurement is only at a single point, with the described system, for this system to yield information across the plasma the laser must be scanned across the plasma, while allowing for passage of the resulting ions to the energy analyzer.

Figure 5:
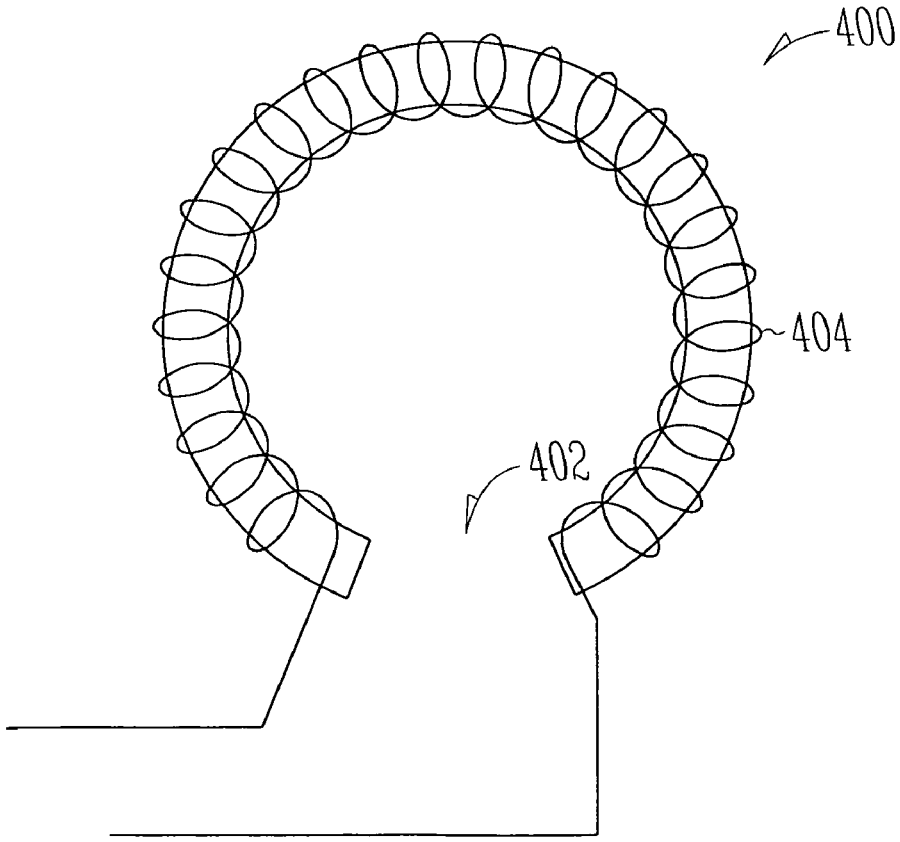
FIG. 5 schematically depicts one configuration of a magnetic steering device for an ion beam suitable for use with the systems of FIGS. 1 and 3.

Referring now to FIG. 5, the figure depicts an alternative steering mechanism in the form of a generally toroidal coil 400 that may be used in place of either or both of the previously-described sets of deflection plates 116, 118. Coil 400 includes at least one conductor, such as the wire 404 wound around a generally circular core 406, having a break therein, indicated generally at 402, to facilitate the traverse of ions therethrough. Those skilled in the art will recognize that other mechanisms for establishing an appropriate magnetic field may also be used for the directing and/or focusing of charge particles originating with ion gun 106.

Many modifications and variations may be made in the techniques and structures described and illustrated herein, without departing from the spirit and scope of the present invention. For example, as is apparent from the preceding discussion, there may be other types of lasers that are suitable, and in some cases preferable, depending upon the atoms to be ionized and the specific configuration of a plasma monitoring system. Additionally, there may be alternative structures which may be assembled in order to produce atoms from ion gun 106 and the photons from laser 104 along a coincident path. Additionally, there may be additional excitation mechanisms used to elevate the energy state of certain atoms thereby further facilitating photon ionization of those atoms under appropriate conditions. Accordingly, it should be readily understood that the scope of the invention includes all of these and other variations which will be apparent to those skilled in the art having the benefit of the present disclosure.

I claim:

1. A method for evaluating a plasma within a chamber, comprising the acts of:

directing a beam of atoms into said chamber and through at least a portion of the plasma, said beam of atoms comprising neutral atoms;

intersecting said beam comprising neutral atoms with laser-generated photons, at least some of said photons having sufficient energy to excite said neutral atoms to an ionized state; and determining the approximate energy of said ionized neutral atoms after passing through the plasma.

2. The method of claim 1, wherein said beam of atoms and said photons follow essentially the same path through at least a portion of said plasma.

3. The method of claim 1, wherein the act of directing a beam of atoms within said chamber and through at least a portion of the plasma comprises the acts of:

utilizing an ion gun to accelerate a beam of ions; and removing the charge on at least a portion of said ions by directing said ion beam through a charge transfer mechanism.

4. The method of claim 1, wherein said act of determining the approximate energy of neutral atoms excited by said photons and said plasma comprises determining the relative energy of said neutral atoms excited by said photons after said atoms have passed through said plasma.

5. A method for evaluating at least one property of a plasma, comprising the acts of:

projecting a beam of neutral atoms of a selected element through said plasma;

ionizing at least a portion of the atoms in the beam of atoms by directing a laser at the beam of neutral atoms, and interacting photons from the laser with neutral atoms in said beam of atoms;

measuring the relative energy of said atoms passing through said plasma; and evaluating a property of said plasma in response to said measured relative energy.

6. The method of claim 5, wherein the act of measuring the relative energy of said atoms passing through said plasma is performed at a plurality of time intervals, and wherein the act of evaluating a property of said plasma in response to said determined relative energy comprises identifying the plasma potential across a dimension of the plasma.

7. The method of claim 5, wherein the selected element is sodium.

8. The method of claim 5, wherein the act of projecting a beam of neutral atoms of a selected element through said plasma comprises:

accelerating an ion beam with an ion gun; and passing said ion beam through a charge exchange assembly to neutralize the charge on at least a portion of the ions in said beam.

9. An apparatus for evaluating at least one characteristic of a plasma, comprising:

an assembly configured to provide an accelerated beam of atoms of a selected element, at least some atoms in said beam being in a neutral state, said assembly configured to direct said accelerated beam comprising neutral atoms through said plasma;

a photon source configured to provide a beam of photons having sufficient energy to ionize at least a portion of said atoms in said accelerated beam of atoms, said photon source arranged to direct said beam of photons to interact with said accelerated beam comprising neutral atoms and to ionize at least a portion of the neutral atoms; and an energy analyzer configured to determine the relative energy of at least a portion of said ionized atoms after said atoms have passed through said plasma.

10. The method of claim 9, wherein said assembly configured to provide an accelerated beam of atoms comprises:

an ion gun providing a beam of ions of said selected element; and a charge transfer assembly cooperatively arranged relative to said ion gun and configured to remove the charged state from at least a portion of said ions from said ion gun before the ions pass into the plasma.

11. The method of claim 9, wherein said photon source comprises a laser.

12. The method of claim 11, wherein said laser is arranged to place the beam of photons coextensive with at least a portion of said accelerated beam of atoms.

13. A method for evaluating at least one property of a cold plasma, comprising the acts of:

projecting a beam of ions of a selected element through a neutralizing device to neutralize charge on at least a portion of the ions in the ion beam to provide a beam containing neutral atoms;

projecting the beam of neutral atoms through the cold plasma;

ionizing at least a portion of the neutral atoms in the beam of atoms by directing a laser at the beam of neutral atoms, and interacting photons from the laser with the neutral atoms;

measuring the relative energy of said atoms passing through said plasma; and evaluating a property of said cold plasma in response to said measured relative energy.

14. An apparatus for evaluating at least one characteristic of a plasma, comprising:

an assembly configured to provide an accelerated beam of ions of a selected element;

a charge transfer mechanism configured to receive the beam of ions and to remove the charge from at least a portion of the ions in the beam to provide atoms in said beam in a neutral state;

a plasma chamber arranged to receive the beam comprising neutral atoms;

a laser photon source configured to provide a beam of photons having sufficient energy to ionize at least a portion of said neutral atoms passing through a plasma in the plasma chamber; and an energy analyzer configured to determine the relative energy of at least a portion of said ionized atoms after said atoms have passed through said plasma.

* * * * *